US006324830B1

(12) United States Patent
Spooner et al.

(10) Patent No.: US 6,324,830 B1
(45) Date of Patent: Dec. 4, 2001

(54) GAS TURBINE ENGINES

(75) Inventors: Michael P Spooner; Anthony Pidcock; Desmond Close, all of Derby (GB)

(73) Assignee: Rolls-Royce plc, London (GB)

( * ) Notice: Subject to any disclaimer, the term of this patent is extended or adjusted under 35 U.S.C. 154(b) by 0 days.

(21) Appl. No.: 09/672,446

(22) Filed: Sep. 29, 2000

(30) Foreign Application Priority Data

Oct. 13, 1999 (GB) ..... 9924121

(51) Int. Cl.[7] ..... F02C 2/00
(52) U.S. Cl. ..... 60/39.31; 60/740
(58) Field of Search ..... 60/39.091, 39.31, 60/740, 748

(56) References Cited

U.S. PATENT DOCUMENTS 4,870,818 * 10/1989 Suliga ..... 60/740
5,239,832 * 8/1993 Koshoffer et al. ..... 60/740
5,465,571 * 11/1995 Clark ..... 60/740

FOREIGN PATENT DOCUMENTS 0 562 762 A 9/1993 (EP) .

* cited by examiner

*Primary Examiner*—Louis J. Casaregola
(74) *Attorney, Agent, or Firm*—W. Warren Taltavull; Manelli, Denison & Selter PLLC

(57) ABSTRACT

A fuel injector assembly designed to withstand a predetermined impact load resulting from ingestion of a bird or other foreign object into the combustion stage of a gas turbine engine comprises a body member adapted to be mounted adjacent to and to extend into the combustion chamber and an abutment member disposed downstream of the injector assembly in the direction of air flow through the combustion stage, the arrangement being such that the body member moves into contact with the abutment member when subjected to an impact load in excess of the impact load it is designed to withstand.

14 Claims, 3 Drawing Sheets

GAS TURBINE ENGINES

FIELD OF THE INVENTION

The present invention relates to gas turbine engines.

BACKGROUND OF THE INVENTION

A problem occasionally encountered by aircraft is collision with birds. This can result in birds being drawn into one or more of the aircraft engines and impacting engine components. The present invention is concerned with design of fuel injector components of the combustor of a gas turbine engine to resist bird impact.

Modern gas turbine engine combustors incorporate an annular combustion chamber into which fuel is directed from a series of fuel injectors spaced apart around the combustion chamber. These fuel injectors are liable to damage by impact from birds or other solid objects drawn into the front of the engine through the compressor stage of the engine. In order to minimise such damage, fuel injectors require to be designed to resist a direct impact without undergoing deformation or damage and without causing fuel leakage. Consequently fuel injectors require to be constructed from high strength materials and to be of robust construction. As a result they are relatively heavy, expensive to produce and bulky, and produce an impediment to and a pressure loss in air flow to the combustion chamber.

SUMMARY OF THE INVENTION

It is an object of the present invention to provide an improved fuel injection assembly which is adapted to withstand bird impact but is of less bulky and expensive construction than hitherto.

The invention provides a fuel injector assembly for a combustion chamber of a gas turbine engine, the assembly comprising a fuel injector having a body member adapted to be mounted adjacent to the combustion chamber and having an outlet end adapted to extend into the combustion chamber to deliver fuel thereto during operation, said body member being constructed to withstand an impact load up to a predetermined magnitude in a direction tending to move the body member towards or into the combustion chamber, and the assembly including restraining means associated with said body member to limit movement of the body member when subjected to an impact load in said direction greater than said predetermined magnitude.

Preferably said restraining means comprises abutment means disposed downstream of said body member in the direction of air flow through the combustion chamber such that said body member moves into contact with the abutment means when subjected to an impact load greater than said predetermined magnitude.

Preferably said abutment means is mounted on or in the combustion chamber.

In one embodiment the abutment means includes a projection or pad carried by said body member and adapted to abut an outer surface of said combustion chamber. Alternatively said abutment means may comprise a projection or pad carried by the combustion chamber and adapted for abutment by said body member.

In a further embodiment said restraining means includes a flange extending radially outwardly relative to said body member and disposed adjacent a portion of the combustion chamber, said flange being adapted to move into contact with said portion of the combustion chamber when the body member is subjected to an impact load greater than said predetermined magnitude.

In a further embodiment said restraining means includes a pin rigidly connected to the combustion chamber and adapted to engage with a complementary formation on said body member. Preferably said pin comprises an extension of a mounting pin serving to mount the combustion chamber in the engine.

The invention also provides a combustion assembly for a gas turbine engine comprising a combustion chamber fitted with at least one fuel injector assembly according to the preceding paragraphs.

BRIEF DESCRIPTION OF THE DRAWINGS

Embodiments of the invention will now be described, by way of example only, with reference to the accompany diagrammatic drawings, in which.

DETAILED DESCRIPTION OF THE INVENTION

Figure 1:
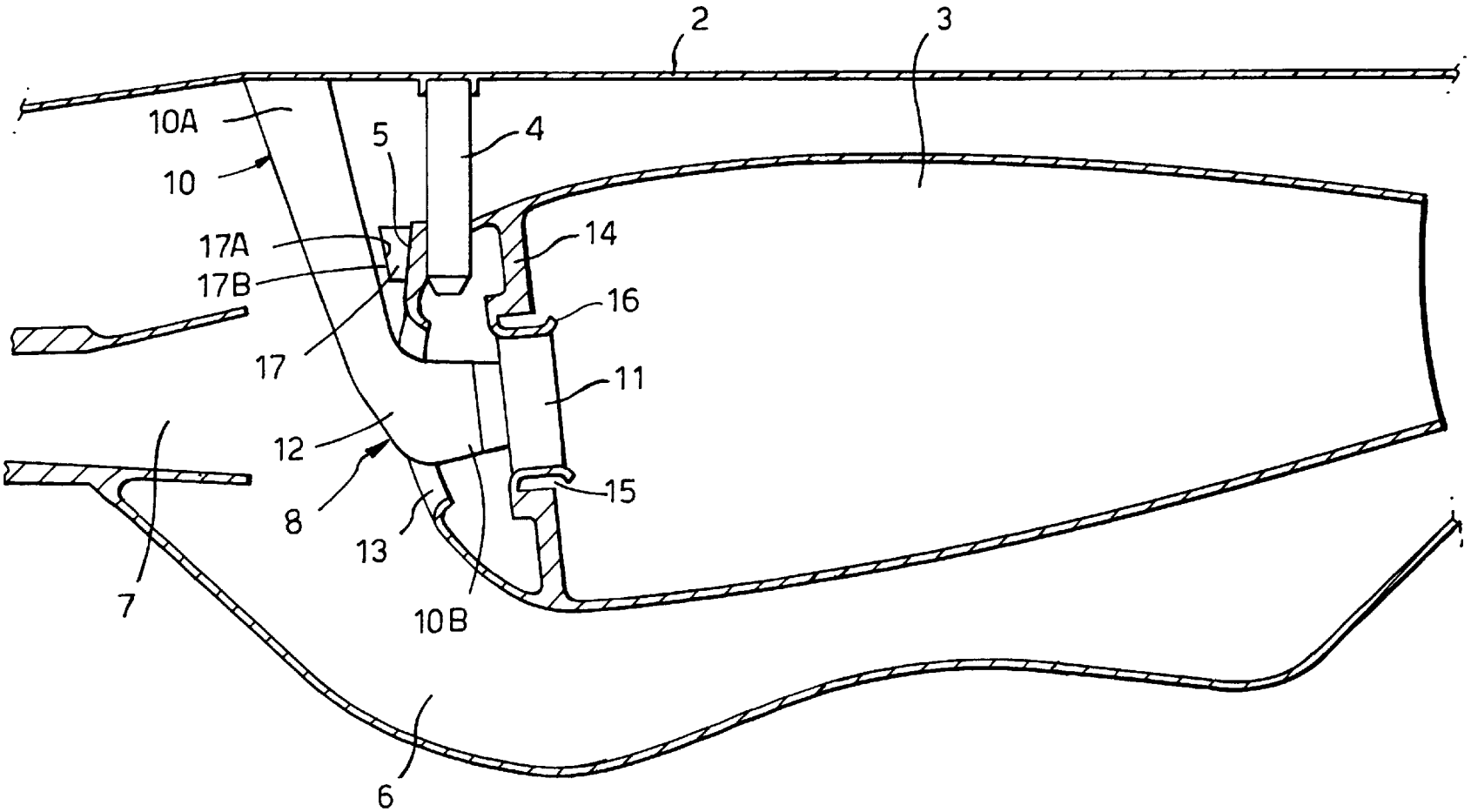
FIG. 1 is a cross section through a combustion chamber of a gas turbine engine showing a fuel injector assembly according to a first embodiment of the invention.

Referring to FIG. 1 of the drawings, there is shown a vertical cross section through the upper part of the combustion stage of a gas turbine engine which incorporates a casing 2 within which an annular combustion chamber 3 is mounted. The combustion chamber is held in position at its front end by mounting means comprising a plurality of mounting pins 4 secured in the casing 2 and circumferentially spaced around and engaged in complementary sockets 5 in the combustion chamber. The rear end of the chamber is also rigidly mounted in the surrounding casing by means not shown.

The combustion chamber 3 is located in an annular air flow passage 6 into which high pressure air is discharged through a duct 7 from the compressor stage of the engine. Air emitted from the duct 7 passes around and into the combustion chamber, the air passing into the chamber being mixed with fuel introduced through a series of fuel injectors spaced apart around the circumference of the combustion chamber.

Each fuel injector 8 comprises a body portion 10 and an atomiser head or nozzle 11. The body member 10 comprises a main support arm 10A mounted on and extending inwardly from the casing 3 to an elbow 12 from which a shorter support arm 10B extends generally axially into the combustion chamber through an inlet aperture 13 in the chamber wall. The atomising head 11 is mounted at the free end of the arm 10B and is supported in an aperture 15 in a rigid annular partition 14 within the combustion chamber. The head 11 is centralised in the aperture 15 by a resilient collar 16.

In operation fuel is introduced to the atomising head 11 through the fuel injector 8. Compressed air for combustion passes from the duct 7 through the inlet aperture 13 and into the combustion chamber where it is mixed with atomised fuel delivered from the atomising head 11. Combustion gases produced in the combustion chamber then flow through and drive the turbine stages of the engine.

The elbow 12 of each injector 8 is positioned directly opposite the air inlet duct 7. As such, a bird drawn into the engine and passing through the compressor stage is liable to impact directly on one or more of the fuel injectors. This can have the effect of pushing the injector further into the combustion chamber, forcing the head 11 into the combustion zone and also resulting in a change in the direction in which atomised fuel is discharged into the chamber. In order to avoid this problem, an abutment member 17 is mounted on the socket 5 in which the locating pin 4 is engaged. The abutment member 17 comprises a projection which extends forwardly from the socket 5 and terminates in a flat face 17*a* disposed in close proximity to the adjacent portion of the body member 10. The gap 17B between the body member and the abutment member is sufficient to limit movement of the body member towards the combustion chamber in the event of impact by a bird or other foreign object during engine operation.

The gap 17B between the body member 10 and the abutment member 17 may be selected such that movement of the body member is limited to within the elastic limit of the material from which the body member is constructed so that, following impact, the body member moves back to its original position. Alternatively the gap 17B may be such as to permit movement of the body member beyond its elastic limit but to a controlled extent which limits plastic deformation to an extent which does not materially interfere with fuel supply through the injector to the combustion chamber or with combustion performance.

Figure 2:
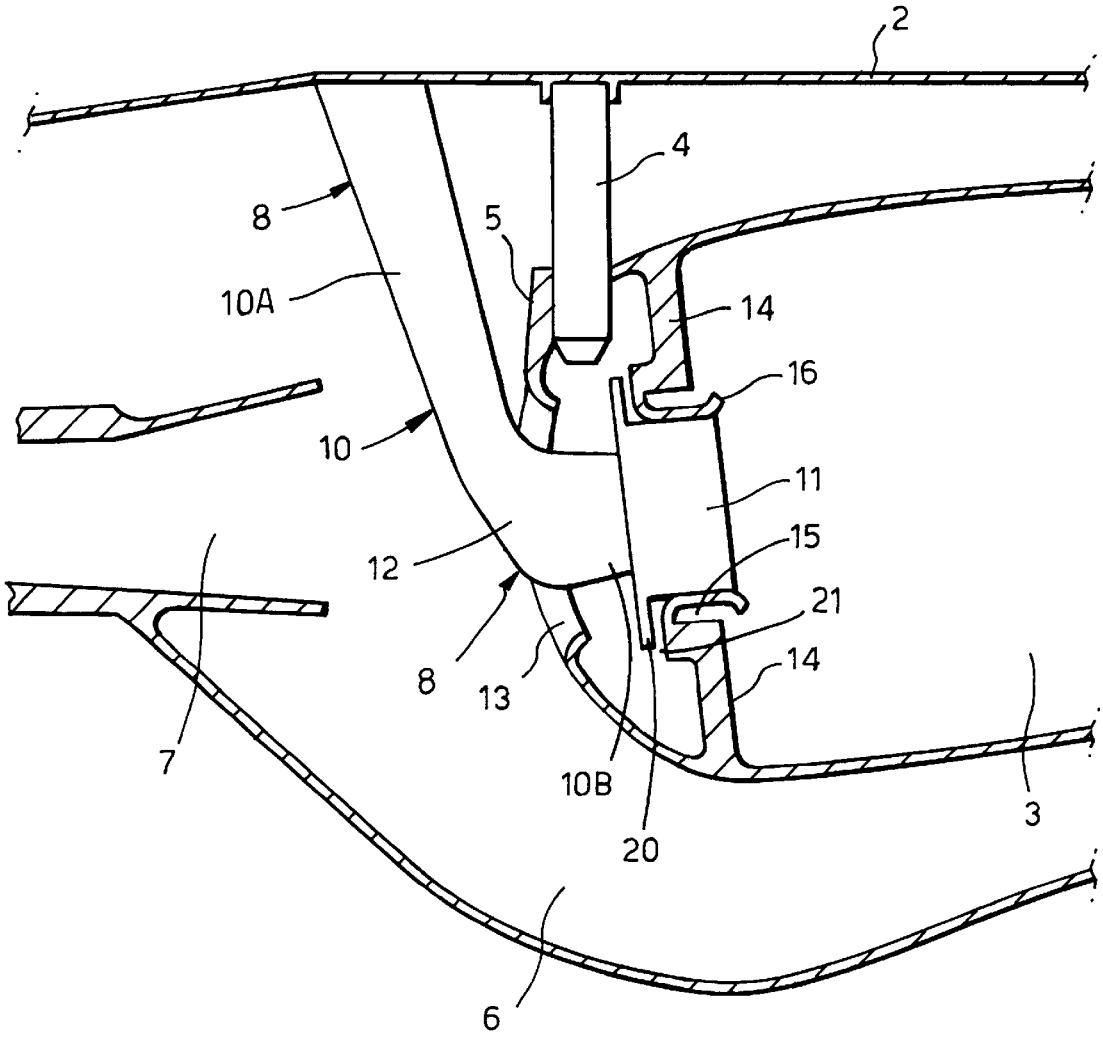
FIG. 2 is an enlarged fragmentary cross section showing an alternative embodiment.

FIG. 2 shows an alternative arrangement in which corresponding parts are indicated by the same reference numerals as in FIG. 1. The abutment means alternatively comprises a flange 20, which cooperates with the rigid annular portion 14, in similar fashion to the abutment member 17 and the body member 10. The flange 20 projects radially from the atomizing head 11 at the upstream end thereof. The flange 20 is spaced axially from the partition 14 in which the atomizing head is supported whereby to leave a gap 21 between them when the body member 10 is in its normal operating position as shown in FIG. 2. In the event of impact by a bird or other solid object emerging from the passage 7, the body member may move axially to the extent determined by the size of the gap 21, at which point the flange 20 abuts the partition 14 and prevents further axial movement. The size of the gap 21 is designed such that the body member will either spring back to its initial position following impact or will deform plastically to the extent permitted by the gap 21 to a position in which the atomizing head is axially displaced inwardly of the combustion chamber 6 but the deformation of the fuel injector is not such as to cause fuel leakage or interfere substantially with the operation of the injector or with combustion performance.

Figure 3:
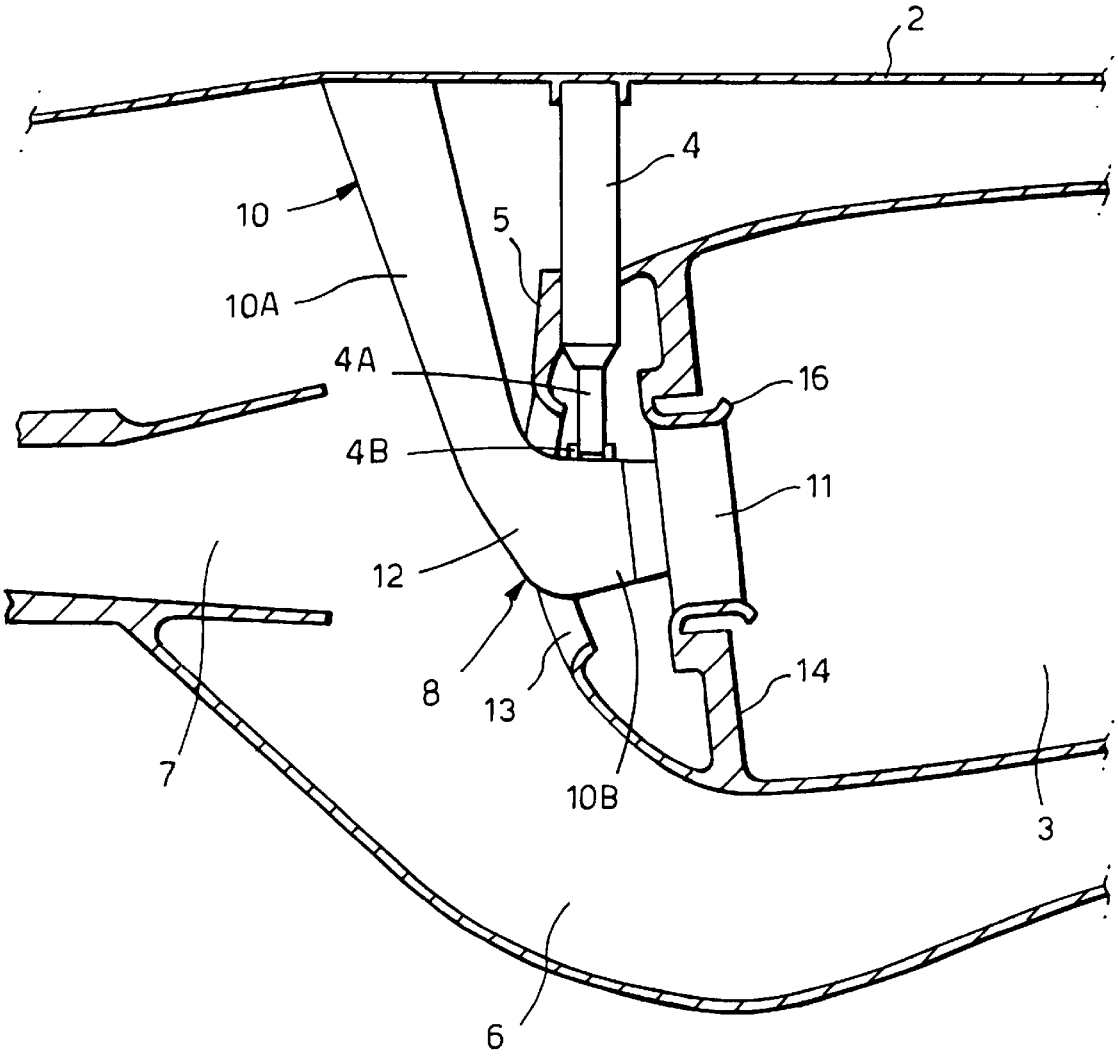
FIG. 3 is a cross section similar to FIG. 2 showing a further embodiment.

FIG. 3 of the drawings shows a further embodiment in which similar reference numerals have again been used to indicate parts corresponding to those described with reference to FIG. 1. In FIG. 3, each of the combustion chamber mounting pins 4 is provided with an axial extension 4A which engages in a recess defined by an annular boss 4B formed on the axially extending arm 10B of the injector assembly 8. In the event of impact by a bird or other solid object, the extension 4A flexes to permit limited movement of the body member 10 under the impact load. The arrangement may be such that the pin either springs back to its original position following impact or deforms plastically to a predetermined degree sufficient to limit movement of the fuel injector to an extent insufficient to cause fracture, fuel leakage or other damage and so as not to alter the position of the injector head relative to the combustion chamber sufficiently to result in unacceptable combustion performance.

It will be appreciated that a plurality of fuel injector assemblies are arranged circumferentially around the combustion chamber, each co-operating with an associated inlet opening 13. The fuel injector assemblies lie in the path of air flow through the engine and into the combustion chamber and as such interfere with that air flow and produce a pressure loss. In order to minimise this pressure loss the injector assemblies are preferably aligned in the direction of air flow through the engine with the mounting pins 4 by means of which the combustion chamber is mounted in the engine. The bosses 5 in which the pins 4 locate, and the pins themselves, interfere with air flow around the combustion chamber for cooling purposes. By aligning the injector assembly 8 with an associated pin 4, the interference with air flow is confined to the region of the pins and is therefore minimised compared with the case where the injector assemblies are positioned out of alignment with the pins and therefore produce additional interference with air flow at different circumferential positions from those of the pins.

The arrangements described provide a means whereby a fuel injector assembly for the combustion stage of a gas turbine engine may be designed to satisfactorily withstand a predetermined impact load derived from an ingested bird or other solid object without requiring to construct the assembly to remain rigid. Instead the assembly is constructed in a manner which permits a limit degree of movement when the assembly is subjected to an impact load of or above a predetermined load for which the assembly is designed, the movement being controlled such that the injector either returns to its original position or deformation is limited to an extent which does not interfere with fuel delivery or combustion performance. This enables the fuel injector itself to be of less robust construction, thereby resulting in a saving in cost and weight. The size of the fuel injector may also be reduced thereby reducing interference with air flow to the combustion chamber.

Various modifications may be made without departing from the invention. For example the construction of the combustion chamber and injector assemblies may differ from that shown. In particular, the invention may be applied to engines having multiple, tubo-annular or other forms of combustion chambers. Alternative means of limiting movement of the injector on impact may be employed and the number and position of injector assemblies provided around the combustion chamber may be altered as desired. Moreover while particularly suitable for use in engines for powering civil aircraft, the invention may also be employed in military aircraft engines or industrial engines.

We claim:

1. A fuel injector assembly for a combustion chamber of a gas turbine engine, the assembly comprising a fuel injector having a body member adapted to be mounted adjacent to the combustion chamber and having an outlet end adapted to extend into the combustion chamber to deliver fuel thereto during operation, said body member being constructed to withstand an impact load up to a predetermined magnitude in a direction tending to move the body member towards or into the combustion chamber, and the assembly including restraining means associated with said body member to limit movement of the body member when subjected to an impact load in said direction greater than said predetermined magnitude.

2. A fuel injector assembly according to claim 1 in which said restraining means comprises abutment means disposed downstream of said body member in the direction of air flow through the combustion chamber, such that said body member moves into contact with the abutment means when subjected to an impact load greater than said predetermined magnitude.

3. A fuel injector assembly according to claim 2 wherein said abutment means comprises an abutment member mounted on the combustion chamber and adapted for abutment by said body member.

4. A fuel injector assembly according to claim 3 wherein said abutment means is associated with mounting means for mounting the combustion chamber in the engine.

5. A fuel injector assembly according to claim 4 wherein said mounting means comprises a mounting fin aligned with said body member in the direction of air flow through the combustion chamber.

6. A fuel injector assembly according to claim 2 wherein said abutment means comprises a flange extending radially outwardly relative to said body member and disposed adjacent a portion of the combustion chamber, said flange being adapted to move into contact with said portion of the combustion chamber when the body member is subjected to an impact load greater than said predetermined magnitude.

7. A fuel injector assembly according to claim 6 wherein said flange is mounted within the combustion chamber adjacent the outlet end of the body member, said portion of the combustion chamber comprising a rigid partition within the combustion chamber.

8. A fuel injector assembly according to claim 7 wherein said partition serves to locate the outlet end of the body member within the combustion chamber.

9. A fuel injector assembly according to claim 1 wherein said restraining means includes a pin rigidly connected to the combustion chamber and adapted to engage with an annular boss on said body member.

10. A fuel injector assembly according to claim 9 wherein said pin comprises an extension of a mounting pin by means of which the combustion chamber is mounted in the engine.

11. A combustion assembly for a gas turbine engine comprising a combustion chamber and a plurality of fuel injector assemblies according to claim 1.

12. A gas turbine engine incorporating a combustion assembly according to claim 11.

13. A fuel injector assembly according to claim 1 wherein said restraining means and the body member define a gap therebetween such that when the body member is subject to an impact load, above the predetermined load, the body member deflects to abut the restraining means, which limits the movement to within the elastic limit of the material from which the body member is constructed, whereby the body member springs back to its original position when the impact load is removed.

14. A fuel injector assembly according to claim 1 wherein the restraining means and the body member define a gap therebetween such that when the body member is subject to an impact load, above the predetermined load, a limited amount of plastic deformation of the body member is permitted prior to the body member abutting the restraining means, whereby plastic deformation is limited to an extent which does not result in unacceptable combustion performance.

* * * * *